United States Patent [19]

Plucknett

[11] Patent Number: 4,739,723

[45] Date of Patent: Apr. 26, 1988

[54] BODY BOARD PROTECTOR

[76] Inventor: Duane D. Plucknett, 6278 N. Federal Hwy., Suite 259, Fort Lauderdale, Fla. 33308

[21] Appl. No.: 6,757

[22] Filed: Jan. 27, 1987

[51] Int. Cl.[4] ..... B63B 17/00

[52] U.S. Cl. ..... 114/361; 114/219; 441/74

[58] Field of Search ..... 114/343, 344, 361, 219; 441/65, 74

[56] References Cited

U.S. PATENT DOCUMENTS

| | | | |
|---|---|---|---|
| 3,032,784 | 5/1962 | Randrup | 114/219 X |
| 3,374,495 | 3/1968 | Joyce | 441/74 |
| 4,556,003 | 12/1985 | Prade | 441/74 X |
| 4,586,451 | 5/1986 | Mori | 114/219 |
| 4,667,619 | 5/1987 | Nishida | 114/361 |

*Primary Examiner*—Joseph F. Peters, Jr.
*Assistant Examiner*—Paul E. Salmon
*Attorney, Agent, or Firm*—Oltman and Flynn

[57] ABSTRACT

A one-piece hard and slippery plastic cover mounts to the bottom of a body board. The cover forms a faster sliding surface and protective shield for the body board.

1 Claim, 1 Drawing Sheet

BODY BOARD PROTECTOR

FIELD OF THE INVENTION

The present invention relates to a body board protector. Its purpose is to extend the life of body boards when used recreationally in the surf.

BACKGROUND OF THE INVENTION

Wave riders and body surfers use body boards in the prone position. The body board extends the surface area of the body surfer and provides a faster ride. Lifeguards also use body boards for patrolling the waterways. Body boards are generally made of a spongy material such as foam, rubber or plastic. This construction provides light weight and low cost. The drawbacks of a spongy construction include a rough bottom surface which slows the body board, and fragility. Body boards are constantly subjected to sliding over sand, shells and rocks. These coarse materials can tear up the bottom of a spongy body board.

SUMMARY OF THE INVENTION

It is, therefore, an object of the present invention to provide a relatively hard protective cover for the bottom of a body board functioning to prolong the life the body board.

Another object of the present invention is to provide a protective cover for the bottom of a body board which has a smooth surface to increase the speed of the body board.

Another object of the present invention is to provide a protective cover for the bottom of a body board which also protects the nose of the body board.

Another object of the present invention is to provide a protective cover for the bottom of a body board which has rapidly installed fastening means.

Another object of the invention is to protect the bottom of a body board against the sun.

Other objects of this invention will appear from the following description and appended claims, reference being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

Figure 1:
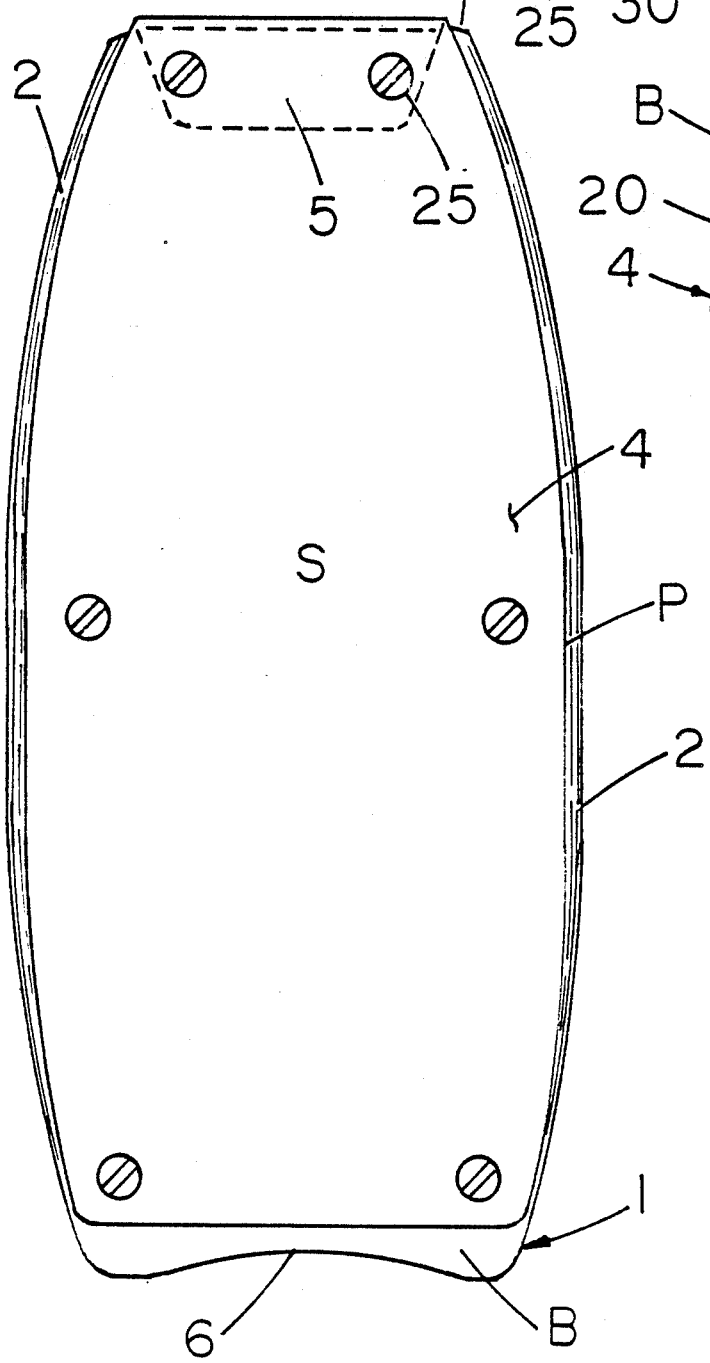
FIG. 1 shows a front elevational view of the body board.
Figure 2:
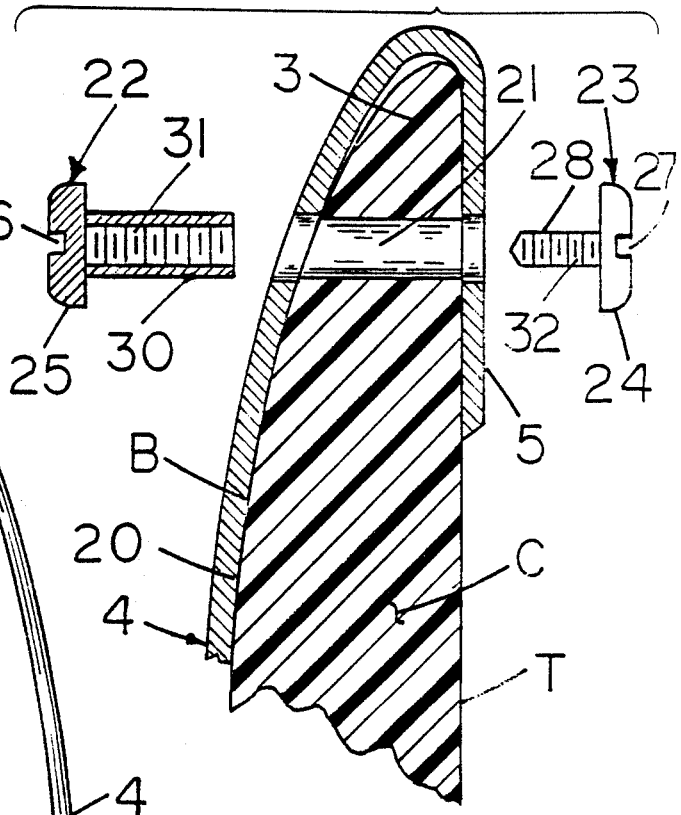
FIG. 2 shows a partial sectional view of the front of the body board and a threaded bolt fastener for the nose protector.

Referring to FIGS. 1 and 2, body board 1 has a spongy core C, a nose 3 and a tail 6. The side edges 2 slope inward from the top of the body board T to the bottom surface B.

The body board protector 4 has a curled nose section 5 and a perimeter P. Perimeter P generally follows the contours of the bottom B of body board 1. The bottom surface S of body board protector 4 is smooth, shiny and slippery. Body board protector 4 is made of a relatively hard one piece plastic or the equivalent:

Fastening means are shown here as bolt 23 and nut 22. Bolt head 24 and nut head 25 are broad and flat and have screwdriver slots 27 and 26. They provide a firm fastening means around spongy core C and avoid protrusion from otherwise flat surfaces T and S. A hole 21 must be drilled for each nut and bolt assembly 22, 23. Nut 22 has a hollow cylindrical column 30 which provides support inside hole 21 for the spongy core C. Inside column 30 are threads 31 which match threads 32 on the stud 28 of bolt 23.

I claim:

1. A body board protector for a spongy body board having an oblong shape with a front and a rear and top and bottom surfaces comprising:

a bottom section for attachment to the bottom surface of the body board;

said bottom section conforming generally to the shape of the body board and having a relatively smooth and slippery bottom surface;

said bottom section having a relatively hard plastic composition for protecting the body board;

a curved nose section for curving from said bottom section around the front of said body board to the top surface thereof;

and fastening means for attaching said body board protector to the body board including a nut and bolt type fastener to extend through said bottom section, the body board and said nose section.

* * * * *